US008193401B2

(12) United States Patent
McGehee et al.

(10) Patent No.: US 8,193,401 B2
(45) Date of Patent: Jun. 5, 2012

(54) COMPOSITION OF HYDROCARBON FUEL

(75) Inventors: James F. McGehee, Mount Prospect, IL (US); Lorenz J. Bauer, Schaumburg, IL (US)

(73) Assignee: UOP LLC, Des Plaines, IL (US)

( * ) Notice: Subject to any disclaimer, the term of this patent is extended or adjusted under 35 U.S.C. 154(b) by 196 days.

(21) Appl. No.: 12/636,135

(22) Filed: Dec. 11, 2009

(65) Prior Publication Data

US 2011/0139676 A1 Jun. 16, 2011

(51) Int. Cl.
*C07C 13/00* (2006.01)
*C07C 15/00* (2006.01)
*C10M 105/06* (2006.01)

(52) U.S. Cl. ..... 585/24; 208/14; 208/22; 208/23; 208/39

(58) Field of Classification Search ..... 585/24; 208/14, 22, 23, 39
See application file for complete search history.

(56) References Cited

U.S. PATENT DOCUMENTS

| | | | | |
|---|---|---|---|---|
| 2,970,957 | A | 2/1961 | Northcott et al. | |
| 3,227,645 | A | 1/1966 | Frumkin et al. | |
| 3,230,164 | A | 1/1966 | Williams et al. | |
| 3,723,297 | A | 3/1973 | Gatsis et al. | |
| 4,528,100 | A | 7/1985 | Zarchy | |
| 4,569,753 | A | 2/1986 | Busch et al. | |
| 4,750,985 | A | 6/1988 | Aldridge et al. | |
| 4,963,247 | A | 10/1990 | Belinko et al. | |
| 4,969,988 | A | 11/1990 | Jain et al. | |
| 5,024,750 | A | 6/1991 | Sughrue et al. | |
| 5,124,026 | A | 6/1992 | Taylor et al. | |
| 5,254,274 | A * | 10/1993 | Ho et al. | 508/584 |
| 5,397,491 | A * | 3/1995 | Hons et al. | 252/73 |
| 5,474,977 | A | 12/1995 | Gatsis | |
| 5,755,955 | A | 5/1998 | Benham et al. | |
| 6,491,809 | B1 * | 12/2002 | Briot et al. | 208/18 |
| 6,511,937 | B1 | 1/2003 | Bearden, Jr. et al. | |
| 6,526,741 | B2 | 3/2003 | Whitehead et al. | |
| 7,074,321 | B1 | 7/2006 | Kalnes | |
| 7,384,537 | B2 | 6/2008 | Nagamatsu et al. | |
| 7,608,181 | B2 * | 10/2009 | O'Rear | 208/15 |
| 7,909,989 | B2 * | 3/2011 | Duyvesteyn et al. | 208/390 |
| 2004/0069685 | A1 | 4/2004 | Inomata et al. | |
| 2005/0006279 | A1 | 1/2005 | Gueret et al. | |
| 2006/0118463 | A1 | 6/2006 | Colyar et al. | |
| 2006/0142626 | A1 * | 6/2006 | Campbell et al. | 585/24 |
| 2006/0157385 | A1 | 7/2006 | Montanari et al. | |

(Continued)

FOREIGN PATENT DOCUMENTS

DE 3916732 A1 11/1990

(Continued)

OTHER PUBLICATIONS

U.S. Appl. No. 12/636,137, filed Dec. 11, 2009, McGehee et al.

(Continued)

*Primary Examiner* — Ellen McAvoy
(74) *Attorney, Agent, or Firm* — James C Paschall

(57) ABSTRACT

Slurry hydrocracking a heavy hydrocarbon feed produces a HVGO stream and a pitch stream. At least a portion of the pitch stream is subjected to SDA to prepare a DAO stream low in metals. The DAO is blended with at least a portion of the HVGO stream to provide turbine or marine fuel with acceptable properties for combustion in gas turbines or for marine fuel grades.

20 Claims, 1 Drawing Sheet

U.S. PATENT DOCUMENTS

| | | | | |
|---|---|---|---|---|
| 2006/0163115 | A1 | 7/2006 | Montanari et al. | |
| 2006/0186021 | A1 | 8/2006 | Marchionna et al. | |
| 2008/0103071 | A1* | 5/2008 | Tsai et al. | 508/110 |
| 2008/0149534 | A1 | 6/2008 | Gauthier et al. | |
| 2009/0032436 | A1 | 2/2009 | Takahashi et al. | |
| 2009/0057202 | A1 | 3/2009 | Kulkarni et al. | |
| 2009/0122934 | A1 | 5/2009 | Ferrari et al. | |
| 2009/0127161 | A1 | 5/2009 | Haizmann et al. | |
| 2010/0243518 | A1 | 9/2010 | Zimmerman et al. | |

FOREIGN PATENT DOCUMENTS

| | | | |
|---|---|---|---|
| WO | 2004058922 | A1 | 7/2004 |

OTHER PUBLICATIONS

U.S. Appl. No. 12/636,142, filed Dec. 11, 2009, McGehee et al.
Fujimura et al., Gefinery: New refining concept to utilize residual oil as gas turbine fuel. ACS Natl Mtg, Book of Abstracts 230 (2005) p. 1, Washington DC, Amer. Chem. Soc.
Krulls, G. Edward, Design of treatment systems for industrial gas-turbine fuels—liquid and gaseous, Power V118 N. 10 65-70 (Oct. 1974) McGraw-Hill.
Moore et al., Potential turbine fuels from western Kentucky tar sand bitumen, 193rd ACS Natl. Mtg (Denver 1987), ACS Div. Pet. Chem Prepr. V32 N2 578-83.
PLN: Petrolite Corp, Fuel Treatment reduces a sodium contamination, Process Eng (London) Mar. 1975) Centaur Publishing.
Polfreman et al., The removal of sodium salts from gas-turbine distillate fuel oil, J. Inst. Fuel V51 N. 408 139-43 (Sep. 1978).
Residual Oil Yields clean turbine fuel, Chemical engineering 107 (3) 2000, p. 23.
Bridge et al., The continuing development of hydrocracking, ACS-Chem Inst. Can Joint Conf (Toronto 1970) ADV Che. Ser N. 103 113-29 (1971).
Svensson, Bo, DNV Approves Siemens Gas Turbine for HFO, Royal Belgian Institute of Marine Engineers, 2007.
Haglind, "A review on the use of gas and steam turbine combined cycles as prime movers for large ships. Part III: Fuels and emissions", Energy Conversion and Management 49 (2008) 3476-3482.
Hoogendoorn, "Bio-oil in stationary gas turbines—Technical & Economical Feasibility", Report No. 0656525-R07, Nov. 12, 2007, 111 pages.

* cited by examiner

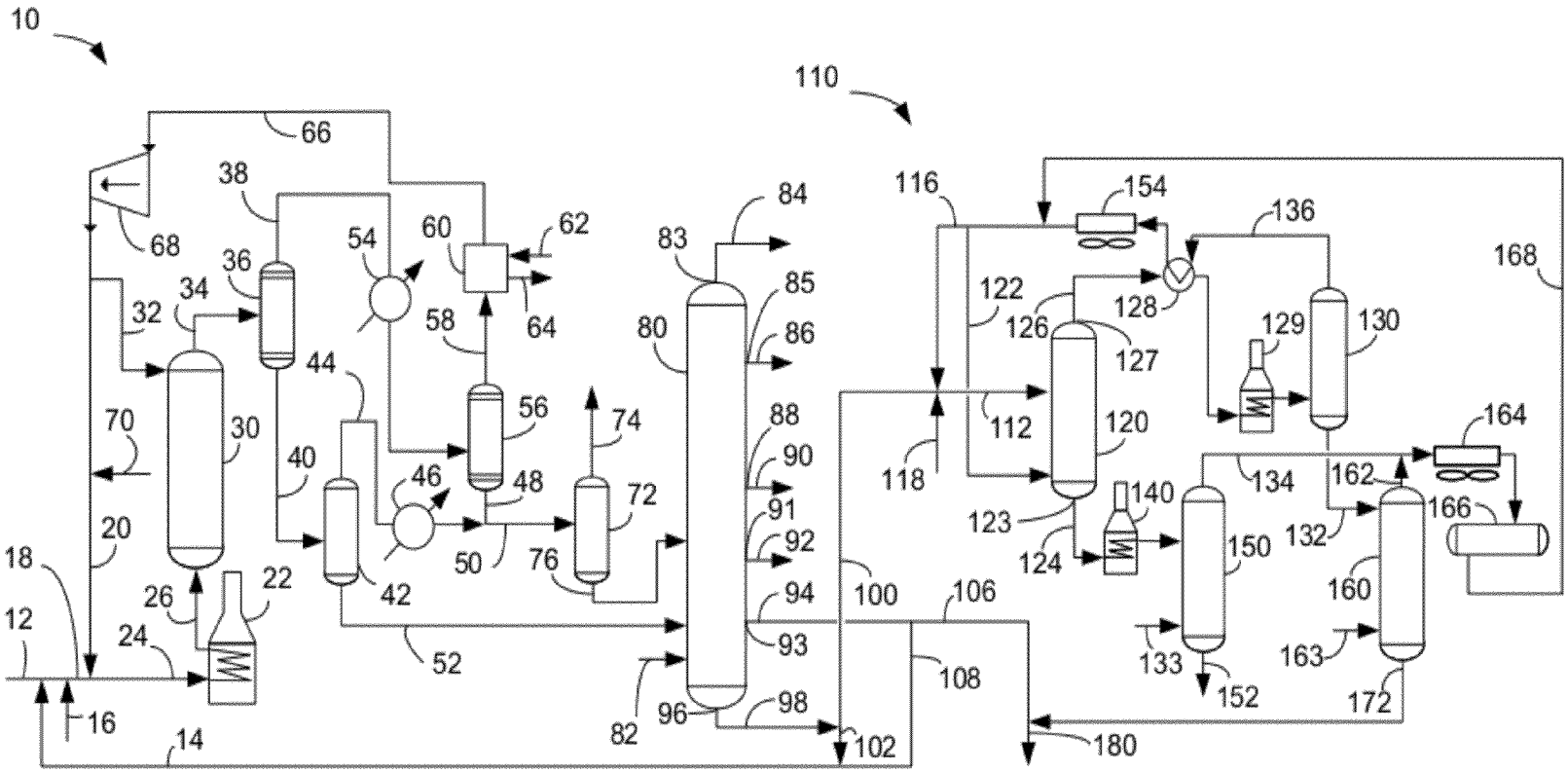
10
12
14
16
18
20
22
24
26
30
32
34
36
38
40
42
44
46
48
50
52
54
56
58
60
62
64
66
68
70
72
74
76
80
82
83
84
85
86
88
90
91
92
93
94
96
98
100
102
106
108
110
112
116
118
120
122
123
124
126
127
128
129
130
132
133
134
136
140
150
152
154
160
162
163
164
166
168
172
180

COMPOSITION OF HYDROCARBON FUEL

FIELD OF THE INVENTION

The present invention relates to a process and apparatus for preparing hydrocarbon fuel by slurry hydrocracking (SHC) and solvent deasphalting (SDA).

DESCRIPTION OF RELATED ART

As the reserves of conventional crude oils decline, heavy oils must be upgraded to meet demands. In upgrading, the heavier materials are converted to lighter fractions and most of the sulfur, nitrogen and metals must be removed. Crude oil is typically first processed in an atmospheric crude distillation tower to provide fuel products including naphtha, kerosene and diesel. The atmospheric crude distillation tower bottoms stream is typically taken to a vacuum distillation tower to obtain vacuum gas oil (VGO) that can be feedstock for an FCC unit or other uses. VGO typically boils in a range between at or about 300° C. (572° F.) and at or about 524° C. (975° F.).

SHC is used for the primary upgrading of heavy hydrocarbon feedstocks obtained from the distillation of crude oil, including hydrocarbon residues or gas oils from atmospheric column or vacuum column distillation. In SHC, these liquid feedstocks are mixed with hydrogen and solid catalyst particles, e.g., as a particulate metallic compound such as a metal sulfide, to provide a slurry phase. Representative SHC processes are described, for example, in U.S. Pat. No. 5,755,955 and U.S. Pat. No. 5,474,977. SHC produces naphtha, diesel, gas oil such as VGO, and a low-value, refractory pitch stream. The VGO streams are typically further refined in catalytic hydrocracking or fluid catalytic cracking (FCC) to provide saleable products. To prevent excessive coking in the SHC reactor, heavy VGO (HVGO) can be recycled to the SHC reactor.

SDA generally refers to refinery processes that upgrade hydrocarbon fractions such as mentioned above using extraction in the presence of a solvent. SDA permits practical recovery of heavier oil, at relatively low temperatures, without cracking or degradation of heavy hydrocarbons. SDA separates hydrocarbons according to their solubility in a liquid solvent, as opposed to volatility in distillation. Lower molecular weight and more paraffinic components are preferentially extracted. The least soluble materials are high molecular weight and most polar aromatic components.

Gas turbines have many uses including aviation propulsion, power generation and marine propulsion. As gas turbine material technology has evolved, the combustion section temperature has increased several hundred degrees, allowing for vast efficiency improvements in the Brayton cycle. The highest efficiency gas turbines can have a hot section operating at above 1093° C. (2000° F.) and therefore have cycle efficiencies much higher than older generation turbines. Higher efficiency gas turbines have created a need for tighter fuel specifications.

According to the article, Svensson, DNV APPROVES SIEMENS GAS TURBINE FOR HFO, 61 Royal Belgian Institute of Marine Engineers 55 (2007), a 17 MW Type SGT-500 gas turbine successfully underwent a comprehensive test using a fuel oil meeting IF180 specification and received DNV (Det Norske Veritas) approval from the Norwegian government for marine applications. At the time of the article, the IFO180 heavy fuel oil was $US 200-250 cheaper than the medium distillate oil typically burned in shipboard gas turbines. The IFO 180 specification is also known as the RME 180 specification applicable to residual marine fuels used in non-turbine engines such as low-RPM diesel engines commonly found in marine systems.

There is a need for such fuel, because turbines are more efficient than many other power sources for generating electricity in small to medium-sized applications such as for peaking power for electric power grids, marine propulsion for fast ships such as ferries, military transport and other applications. Cogeneration facilities which recover the waste heat of the turbine to make steam or provide other low-level heat are other examples of systems which achieve high overall cycle efficiency but require fuel that is suitable for the turbine.

Many previous efforts have made a suitable gas turbine fuel from a low value hydrocarbon residue. One process involved hydroprocessing petroleum residue in which the conditions are adjusted to remove only a small portion of the sulfur and nitrogen but most of the metals over a demetallation catalyst in a "polishing process". An example of this process is known as GEFINERY of Japan Gasoline Corporation. The cost of this process has been considered unjustifiably high based on the limited upgrading margin.

Other processes propose to valorize residue from coal dissolution or "solvent-refined" coal products by hydroprocessing to produce a vacuum distillate. Examples of this process are the SRC (solvent refined coal) process and Hypercoal process of Japan New Energy Development Organization. In another process, residual petroleum is subjected to SDA, wherein the yield of deasphalted oil (DAO) is kept relatively low to avoid pulling any organometallic compounds into the DAO. A last process combines SDA with downstream purification or hydroprocessing of the DAO to remove metals. These three process examples have been considered disadvantageous due to their limited ability to produce suitable fuel meeting applicable specifications.

The special fuel that is the subject of this invention would be less expensive to produce than the typical marine diesel oil or kerosene. Even accounting for the need for downstream pollution control to remove SOx and NOx from the exhaust, it would be advantageous to burn such fuel in turbines.

There is an ongoing need for hydrocarbon fuel compositions that can be inexpensively made and be used in gas turbines and in marine engines.

SUMMARY OF THE INVENTION

In an exemplary embodiment the present invention involves a hydrocarbon composition comprising no less than 73 wt-% aromatics, no more than 5 wt-% heptane insolubles and no more than 50 wppm vanadium. At least 80 vol-% of the composition boils at a temperature above 426° C. (800° F.). In other aspects, the composition may comprise no less than 75 wt-% aromatics, may comprise no more than 5 wt-% hexane insolubles or no more than 5 wt-% pentane insolubles. In another aspect, at least 90 vol-% of the composition boils at a temperature above 426° C. In another aspect, the composition has no more than 30 wppm or no more than 10 wppm vanadium. In a further aspect, the composition has a viscosity of no greater than 180 Cst at 50° C. In a still further aspect, the composition has no more than 5 wppm sodium.

These and other aspects and embodiments relating to the present invention are apparent from the Detailed Description.

DEFINITIONS

The term "aromatic" means a substance comprising a ring-containing molecule as determined by ASTM D 2549.

The term "communication" means that material flow is operatively permitted between enumerated components.

The term "downstream communication" means that at least a portion of material flowing to the subject in downstream communication may operatively flow from the object with which it communicates.

The term "upstream communication" means that at least a portion of the material flowing from the subject in upstream communication may operatively flow to the object with which it communicates.

As used herein, the term "boiling point temperature" means atmospheric equivalent boiling point (AEBP) as calculated from the observed boiling temperature and the distillation pressure, as calculated using the equations furnished in ASTM D1160 appendix A7 entitled "Practice for Converting Observed Vapor Temperatures to Atmospheric Equivalent Temperatures".

As used herein, "pitch" means the hydrocarbon material boiling above about 538° C. (975° F.) AEBP as determined by any standard gas chromatographic simulated distillation method such as ASTM D2887, D6352 or D7169, all of which are used by the petroleum industry.

As used herein, "pitch conversion" means the conversion of materials boiling above 524° C. (975° F.) converting to material boiling at or below 524° C. (975° F.).

As used herein, "heavy vacuum gas oil" means the hydrocarbon material boiling in the range between about 427° C. (800° F.) and about 538° C. (975° F.) AEBP as determined by any standard gas chromatographic simulated distillation method such as ASTM D2887, D6352 or D7169, all of which are used by the petroleum industry.

As used herein, solvent "insolubles" means materials not dissolving in the solvent named.

The term "liquid hourly space velocity" means the volumetric flow rate of liquid feed per reactor volume, wherein the volume is referenced to a standard temperature of 16° C.

BRIEF DESCRIPTION OF THE DRAWING

The FIGURE is a schematic view of a process and apparatus of the present invention.

DETAILED DESCRIPTION

Slurry hydrocracking enables conversion of up to 80-95 wt-% of many low value vacuum bottoms streams to 524° C. (975° F.) and lighter distillate and a small quantity of pitch. The toluene soluble portion of SHC product that boils at 524° C. (975° F.) or higher has relatively low molecular weight, such as 700-900 as measured by vapor pressure osmometry per ASTM D 2503, and is contaminated with some nickel and vanadium. Slurry hydrocracking over iron-based catalysts at pressures below 20.7 MPa (3000 psig) has limited ability to open metalloporphyrinic rings. Surprisingly, it was learned that the pentane soluble portion of the pitch residue boiling over 524° C. from slurry hydrocracking over iron-based catalyst at conversions above 80 wt-% contains very low concentrations of nickel and vanadium. This is in contrast to solvent-deasphalted straight run oils which contain substantial amounts of soluble organometallic nickel and vanadium and would not be possible to run in the latest generation turbines. These metals-laden fuels could only be possibly run in cooler turbines using certain techniques such as metal passivating additives and offline water wash to remove blade deposits.

Also, it was learned that the heaviest portions of the vacuum gas oil distillate boiling in the range of 426-524° C. (800-975° F.) atmospheric equivalent boiling point known as HVGO produced by slurry hydrocracking 524+° C. residue over iron-based catalyst at conversions above 80 wt-% contains no measurable nickel and vanadium. This material also contains some paraffins in the $C_{30}$-$C_{45}$ range as well as multi-ring aromatics and heteroatomic material. This material has excellent fuel properties and is pourable at room temperature. The lighter portion of the vacuum gas oil distillate boiling in the range of 343-426° C. (650-800° F.) atmospheric equivalent boiling point known as LVGO from slurry hydrocracking are suitable for direct burning as turbine fuel, but often it will be desired to upgrade this oil in further processing to naphtha and diesel to better valorize the stream.

Accordingly, HVGO and solvent-deasphalted pitch obtained from SHC may be blended together to provide a hydrocarbon fuel that meets the RME 180 and the IFO 180 fuel specification. Hence, the hydrocarbon fuel may be burned in gas turbines and in marine engines without need of further upgrading. The special composition of hydrocarbon fuel made by the process and apparatus of this invention may be used as-such or in blends with other fuels either in bulk or blended at the point of use.

Embodiments of the invention relate to slurry hydrocracking a heavy hydrocarbon feedstock for primary upgrading into fuel. According to one embodiment, for example, the heavy hydrocarbon feedstock comprises a vacuum column residue. Representative further components of the heavy hydrocarbon feedstock include residual oils boiling above 566° C. (1050° F.), tars, bitumen, coal oils, and shale oils. Bitumen is also known as natural asphalt, tar sands or oil sands. Bitumen has been defined as rock containing hydrocarbons more viscous than 10,000 Cst or such hydrocarbons that may be extracted from mined or quarried rock. Some natural bitumens are solids, such as gilsonite, grahamite, and ozokerite, which are distinguished by streak, fusibility, and solubility. Other asphaltene-containing materials may also be used as components processed by SHC. In addition to asphaltenes, these further possible components of the heavy hydrocarbon feedstock, among other attributes, generally also contain significant metallic contaminants, e.g., nickel, iron and vanadium, a high content of organic sulfur and nitrogen compounds, and a high Conradson carbon residue. The metals content of such components, for example, may be in the range of 100 ppm to 1,000 ppm by weight, the total sulfur content may range from 1 to 7 wt-%, and the API gravity may range from about −5° to about 35°. The Conradson carbon residue of such components is generally at least about 5 wt-%, and is often from about 10 to about 30 wt-%.

As shown in the FIGURE, the present invention for converting heavy hydrocarbons to hydrocarbon fuels is exemplified by a SHC unit 10 and a solvent deasphalting unit 110.

The heavy feed stream in line 12 is presented as feed to the SHC unit 10 as shown in the FIGURE. A heavy product recycle in line 14 may be mixed with the heavy feed stream 12. A coke-inhibiting additive or catalyst of particulate material in line 16 is mixed together with the feed stream in line 12 to form a homogenous slurry. A variety of solid catalyst particles can be used as the particulate material. Particularly useful catalyst particles are those described in U.S. Pat. No. 4,963,247. Thus, the particles are typically ferrous sulfate having particle sizes less than 45 μm and with a major portion, i.e. at least 50% by weight, in an aspect, having particle sizes of less than 10 μm. Iron sulfate monohydrate is a preferred catalyst. Bauxite catalyst may also be preferred. In an aspect, 0.01 to 4.0 wt-% of coke-inhibiting catalyst particles based on fresh feedstock are added to the feed mixture. Oil soluble coke-inhibiting additives may be used alternatively or additionally. Oil soluble additives include metal naphthenate or metal octanoate, in the range of 50 to 1000 wppm based on fresh feedstock with molybdenum, tungsten, ruthenium, nickel, cobalt or iron.

This slurry of catalyst and heavy hydrocarbon feed in line 18 may be mixed with hydrogen in line 20 and transferred into a fired heater 22 via line 24. The combined feed is heated in the heater 22 flows through an inlet line 26 into an inlet in the bottom of the tubular SHC reactor 30. In the heater 22, iron-based catalyst particles newly added from line 16 typically convert to forms of iron sulfide which are catalytically active. Some of the decomposition will take place in the SHC reactor 30. For example, iron sulfate monohydrate will convert to ferrous sulfide and have a particle size less than 0.1 or even 0.01 μm upon leaving heater 22. The SHC reactor 30 may take the form of a three-phase, e.g., solid-liquid-gas, reactor without a stationary solid bed through which catalyst, hydrogen and oil feed are moving in a net upward motion with some degree of back mixing. Many other mixing and pumping arrangements may be suitable to deliver the feed, hydrogen and catalyst to the reactor 30.

In the SHC reactor 30, heavy feed and hydrogen react in the presence of the aforementioned catalyst to produce slurry hydrocracked products. The SHC reactor 30 can be operated at quite moderate pressure, in the range of 3.5 to 24 MPa, without formation of coke. The reactor temperature is typically in the range of about 350° to about 600° C. with a temperature of about 400 to about 500° C. being preferred. The LHSV is typically below about 4 $h^{-1}$ on a fresh feed basis, with a range of about 0.1 to about 3 $hr^{-1}$ being preferred and a range of about 0.2 to about 1 $hr^{-1}$ being particularly preferred. The pitch conversion may be at least about 80 wt-%, suitably at least about 85 wt-% and preferably at least about 90 wt-%. The hydrogen feed rate is about 674 to about 3370 $Nm^3/m^3$ (4000 to about 20,000 SCF/bbl) oil. SHC is particularly well suited to a tubular reactor through which feed and gas move upwardly. Hence, the outlet from SHC reactor 30 is above the inlet. Although only one is shown in the FIGURE, one or more SHC reactors 30 may be utilized in parallel or in series. Because of the elevated gas velocities, foaming may occur in the SHC reactor 30. An antifoaming agent may also be added to the SHC reactor 30 to reduce the tendency to generate foam. Suitable antifoaming agents include silicones as disclosed in U.S. Pat. No. 4,969,988. Additionally, hydrogen quench from line 32 may be injected into the top of the SHC reactor 30 to cool the slurry hydrocracked product as it is leaving the reactor.

A slurry hydrocracked product stream comprising a gas-liquid mixture is withdrawn from the top of the SHC reactor 30 through line 34. The slurry hydrocracked stream consists of several products including VGO and pitch that can be separated in a number of different ways. The slurry hydrocracked effluent from the top of the SHC reactor 30 is in an aspect, separated in a hot, high-pressure separator 36 kept at a separation temperature between about 200° and about 470° C. (392° and 878° F.), and in an aspect, at about the pressure of the SHC reaction. The hot, high pressure separator is in downstream communication with the SHC reactor 30. The optional quench in line 32 may assist in quenching the reaction products to the desired temperature in the hot high-pressure separator 36. In the hot high pressure separator 36, the effluent from the SHC reactor 30 in line 34 is separated into a gaseous stream comprising hydrogen with vaporized products and a liquid stream comprising liquid slurry hydrocracked products. The gaseous stream is the flash vaporization product at the temperature and pressure of the hot high pressure separator. Likewise, the liquid stream is the flash liquid at the temperature and pressure of the hot high pressure separator 36. The gaseous stream is removed overhead from the hot high pressure separator 36 through line 38 while the liquid fraction is withdrawn at the bottom of the hot high pressure separator 36 through line 40.

The liquid fraction in line 40 is delivered to a hot flash drum 42 at about the same temperature as in the hot high pressure separator 36 but at a pressure of about 690 to about 3,447 kPa (100 to 500 psig). The vapor overhead in line 44 is cooled in cooler 46 and is combined with the liquid bottoms from a cold high pressure separator in line 48 and enters line 50. A liquid fraction leaves the hot flash drum in line 52.

The overhead stream from the hot high pressure separator 36 in line 38 is cooled in one or more coolers represented by cooler 54 to a lower temperature. A water wash (not shown) on line 38 is typically used to wash out salts such as ammonium bisulfide or ammonium chloride. The water wash would remove almost all of the ammonia and some of the hydrogen sulfide from the stream in line 38. The stream in line 38 is transported to a cold, high pressure separator 56 in downstream communication with the SHC reactor 30 and the hot high pressure separator 36. In an aspect, the cold high pressure separator 56 is operated at lower temperature than the hot high pressure separator 36 but at about the same pressure. The cold high pressure separator 56 is kept at a temperature between about 10° and about 93° C. (50° and 200° F.) and at about the pressure of the SHC reactor 30. In the cold high pressure separator 56, the overhead of the hot high pressure separator 36 is separated into a gaseous stream comprising hydrogen in line 58 and a liquid stream comprising slurry hydrocracked products in line 48. The gaseous stream is the flash vaporization fraction at the temperature and pressure of the cold high pressure separator 56. Likewise, the liquid stream is the flash liquid product at the temperature and pressure of the cold high pressure separator 56. By using this type of separator, the outlet gaseous stream obtained contains mostly hydrogen with some impurities such as hydrogen sulfide, ammonia and light hydrocarbon gases.

The hydrogen-rich stream in line 58 may be passed through a packed scrubbing tower 60 where it is scrubbed by means of a scrubbing liquid in line 62 to remove hydrogen sulfide and ammonia. The spent scrubbing liquid in line 64 may be regenerated and recycled and is usually an amine. The scrubbed hydrogen-rich stream emerges from the scrubber via line 66 and is recycled through a recycle gas compressor 68 and line 20 back to the SHC reactor 30. The recycle hydrogen gas may be combined with fresh make-up hydrogen added through line 70.

The liquid fraction in line 48 carries liquid product to adjoin cooled hot flash drum overhead in line 44 leaving cooler 46 to produce line 50 which feeds a cold flash drum 72 at about the same temperature as in the cold high pressure separator 56 and a lower pressure of about 690 to about 3,447 kPa (100 to 500 psig) as in the hot flash drum 42. The overhead gas in line 74 may be a fuel gas comprising $C_4$-material that may be recovered and utilized. The liquid bottoms in line 76 from the cold flash drum 72 and the bottoms line 52 from the hot flash drum 42 each flow into the fractionation section 80.

The fractionation section 80 is in downstream communication with the SHC reactor 30 for fractionating at least a portion of said slurry hydrocracked products. The fractionation section 80 may comprise one or several vessels although it is shown only as one vessel in the FIGURE. The fractionation section 80 may comprise an atmospheric stripping fractionation column and a vacuum flash drum column but in an aspect is just a single vacuum column. In an aspect, inert gas such as medium pressure steam may be fed near the bottom of the fractionation section 80 in line 82 to strip lighter components from heavier components. The fractionation section 80 produces an overhead gas product emitting from an overhead outlet 83 in line 84, a naphtha product stream emitting from a side outlet 85 in line 86, a diesel product stream emitting from a side outlet 88 in line 90, a LVGO stream emitting from a side outlet 91 in line 92, a HVGO stream emitting from a side outlet 93 in line 94 and a pitch stream emitting from a bottom outlet 96 in bottoms line 98.

The SHC pitch product stream in bottoms line 98 from bottom outlet 96 will be heavily aromatic and contain SHC catalyst. The pitch will typically boil at above 524° C. (975° F.). The pitch in line 98 is split between line 100 which enters the SDA unit 110 and line 102 for recycle back to the SHC reactor 30. The HVGO product stream in line 94 from the side outlet is split between line 106 for blending and line 108 for recycle back to the SHC reactor 30. Streams in lines 102 and 108 may be combined in line 14. The HVGO product stream will boil at above 427° C. (800° F.) and less than the boiling range for pitch. At least 80 wt-% of the HVGO stream will boil at above 427° C. In an additional aspect, at least 80 wt-% of the HVGO stream will boil below about 524° C. (975° F.). Line 106 carries at least a portion of the HVGO stream from line 94.

The pitch stream in line 100 enters into the SDA unit 110. In the SDA process, the pitch feed stream in line 100 is pumped and admixed with a recycled solvent in line 116 and a make-up solvent in line 118 before entering into a first extraction column 120 as feed in line 112. Additional solvent, for example, recycled solvent, may be added to a lower end of the extraction column 120 via line 122. The light paraffinic solvent, typically propane, butane, pentane, hexane, heptane or mixtures thereof dissolves a portion of the pitch in the solvent. The pitch solubilized in the solvent rises to an overhead of the column 120. The determining quality for solvency of a light hydrocarbon solvent is its density, so equivalent solvents to a particular solvent will have an equivalent density. For example, in an embodiment, heptane is the densest solvent that can be used without lifting high concentrations of vanadium in the DAO. Solvents with lower densities than heptane would also be suitable for lifting lower concentrations of vanadium in the DAO. Specifically, the solvent solubilizes the paraffinic and less polar aromatic compounds in the pitch feed. N-pentane is a suitable solvent. The heavier portions of the feed stream 112 are insoluble and settle down as an asphaltene or pitch stream from pitch outlet 123 in line 124 and a first DAO stream is extracted in an extract emitted in line 126 from DAO outlet 127. The DAO stream in line 126 is the dissolved portion of the pitch. The extraction column 120 will typically operate at about 93° to about 204° C. (200° to 400° F.) and about 3.8 to about 5.6 MPa (550 to 850 psi). The temperature and pressure of the extraction column 120 are typically below the critical point of the solvent but can be above or below the critical point as long as the density is well controlled. The DAO stream in line 126 has a lower concentration of metals than in the feed stream in line 112. The first DAO stream is heated to supercritical temperature for the solvent by indirect heat exchange with heated solvent in the solvent recycle line 136 in heat exchanger 128 and in fired heater 129 or other additional heat exchanger. The supercritically heated solvent separates from the DAO in the DAO separator column 130 which is in downstream communication with an overhead of the first extraction column 120. A solvent recycle stream exits the DAO separator column 130 in the solvent recycle line 136. The solvent recycle stream is condensed by indirect heat exchange in heat exchanger 128 with the extract in line 126 and condenser 154. The DAO separator column 130 will typically operate at about 177° to about 287° C. (350° to 550° F.) and about 3.8 MPa to about 5.2 MPa (550 to 750 psi). The extractor bottoms stream in line 124 contains a greater concentration of metals than in the feed in line 112. The bottoms stream in line 124 is heated in fired heater 140 or by other means of heat exchange and stripped in a pitch stripper column 150 to yield a solvent-lean pitch stream in bottoms line 152 and a first solvent recovery stream in line 134. Steam from line 133 may be used as stripping fluid in the pitch stripper column 150. The pitch stripper column 150 is in downstream communication with a pitch outlet 123 from said solvent deasphalting column 120 for separating solvent from pitch. The pitch stripper 150 will typically operate at about 204° to about 260° C. (400° to 500° F.) and about 344 kPa to about 1,034 kPa (50 to 150 psi). A solvent-lean DAO steam exits the DAO separator column 130 in line 132 and enters DAO stripper column 160 in downstream communication with a bottom of the DAO separator column 130 and said DAO outlet 127. The DAO stripper column 160 further separates a second solvent recovery stream 162 from the DAO stream 132 by stripping DAO from the entrained solvent at low pressure. Steam from line 163 may be used as stripping fluid in the DAO stripper column 160. The DAO stripper column 160 will typically operate at about 149° to about 260° C. (300° to 500° F.) and about 344 kPa to about 1,034 kPa (50 to 150 psi). The second solvent recovery stream leaves in line 162 and joins the first solvent recovery stream in line 134 before being condensed by cooler 164 and stored in solvent reservoir 166. Recovered solvent is recycled from the reservoir 166 as necessary through line 168 to supplement the solvent in line 136 to be mixed with pitch stream in line 100. Essentially solvent-free, DAO, which is at least a portion of the DAO emitted from the DAO outlet 127, is provided in line 172.

DAO, which is the dissolved portion of the pitch, in line 172 is blended with the HVGO in line 106 in a vessel or a line 180, as shown in the FIGURE, to provide a blended product having a hydrocarbon composition comprising no less than 73 wt-% aromatics and preferably no less than 75 wt-% aromatics. Line 180 or unshown vessel is in downstream communication with the HVGO side outlet 93, the pitch outlet 96 and with the DAO outlet 127. The composition may have no more than 5 wt-% heptane insolubles and no more than 50 wppm vanadium. In a further embodiment, the hydrocarbon composition may have no more than 5 wt-% hexane insolubles and no more than 30 wppm vanadium. In a still further embodiment, the hydrocarbon composition may have no more than 5 wt-% pentane insolubles and no more than 10 wppm vanadium. At least 80 vol-%, preferably 90 vol-%, of the composition boils at a temperature at or above 426° C. (800° F.). In an embodiment, the hydrocarbon composition comprises no more than 3.5 wt-% sulfur, suitably no more than 1.0 wt-% sulfur and preferably no more than 0.5 wt-% sulfur. In a further embodiment, the blended hydrocarbon composition has a viscosity of no more than 180 cSt at 50° C. and an average molecular weight of no more than 500. In an embodiment, the hydrocarbon composition has no more than 5 wppm of sodium and preferably no more than 2 wppm, so it can be a suitable turbine fuel.

EXAMPLES

The following examples were conducted to demonstrate the utility of the invention.

Example 1

An SHC reactor was used to convert vacuum residue of bitumen from the Peace River formation of Alberta, Canada at a pitch conversion levels of 80 and 90 wt-%. Respective SHC products were separated to provide a pitch product and a HVGO product. Aromatic concentrations were determined for SHC product fractions by ASTM D2549-02 (2007) Standard Test Method for Separation of Representative Aromatics and Nonaromatics Fractions of High-Boiling Oils by Elution Chromatography. Pitch that leaves the SHC reactor is comfortably assumed to be 100% aromatic molecules at all conversion levels above 80 wt-%. Aromatic concentrations that were determined for each HVGO cut are given in Table I.

TABLE I

| SHC Product | Conversion, wt-% | Boiling Range, ° C. | Aromatics, wt-% |
|---|---|---|---|
| HVGO | 80 | 425-524 | 71.3 |
| HVGO | 90 | 425-524 | 70.8 |
| Pitch | all | 524+ | 100 |

Example 2

An SHC reactor was used to convert the vacuum residue of bitumen from the Peace River formation of Alberta, Canada at a pitch conversion level of 87 wt-%. The SHC product was separated to provide a pitch product and a HVGO product. The pitch product was then subjected to solvent separation using a normal pentane solvent to extract DAO. A blending calculation was conducted to determine properties of a blend of a hydrocarbon composition with selected proportions of the HVGO product and pentane-extracted DAO. The properties of the blended hydrocarbon composition with comparison to the RME180/IFO180 specification are shown in Table II. The RME180/IF180 specification is taken from ISO standard 8217:2005(E) Table 2: Requirements for Marine Residual Oils. Aromatic concentrations of the blends in Table II were determined as a weight average of the aromatic concentration in the HVGO and the pitch cuts from Table I.

TABLE II

| HVGO in blend wt-% | Pitch extract in pentane in blend wt-% | Density g/cc | Micro carbon residue wt-% | Ash wt-% | S wt-% | V ppm | Ni ppm | Pour point ° C. | Viscosity Cst @ 50° C. | Aromatics wt-% |
|---|---|---|---|---|---|---|---|---|---|---|
| 0.79 | 0.21 | 0.9988 | 6.95 | 0.02 | 3.7 | 2.7 | 2.4 | <30 | 306.9 | 77.15 |
| 0.80 | 0.20 | 0.9979 | 6.64 | 0.02 | 3.7 | 2.6 | 2.4 | <30 | 261.3 | 76.80 |
| 0.82 | 0.18 | 0.9961 | 6.03 | 0.02 | 3.7 | 2.6 | 2.3 | <30 | 210.8 | 76.22 |
| 0.85 | 0.15 | 0.9935 | 5.11 | 0.03 | 3.7 | 2.6 | 2.1 | <30 | 149.7 | 75.35 |
| 0.86 | 0.14 | 0.9926 | 4.80 | 0.03 | 3.6 | 2.6 | 2.0 | <30 | 131.2 | 75.06 |
| 0.88 | 0.12 | 0.9909 | 4.19 | 0.03 | 3.6 | 2.6 | 1.9 | <30 | 108.5 | 74.48 |
| RME 180/ IFO 180 specification | | <0.9909 | <15 | <0.1 | <4.5 | <200 | n/a | <30 | <180.0 | n/a |

All blends are expected to have a pour point less than 30° C. based on their physical properties according to Procedure 2B8.1 of the API Petroleum Refining Technical Handbook, vol. 1 (1987). The blend with the ratio of HVGO to pentane soluble pitch equal to 79:21 is calculated to have a viscosity of 1201 Cst, and the blend with the ratio of HVGO to pentane soluble pitch equal to 88:12 is calculated to have a viscosity of 349 Cst at a temperature of 30° C. according to Procedure 2B2.1 and 2B2.3 in the API Petroleum Refining Handbook, vol. 1 (1987). Therefore, all compositions in the table are expected to be pour at less than 30° C.

The blend with the ratio of HVGO to pentane soluble pitch equal to 79:21 is the as-produced composition of SHC products. The blend with the ratio of HVGO to pentane soluble pitch equal to 85:15 has a composition that meets the viscosity specification at 50° C. but is slightly too dense to meet the density specification. The blend with the ratio of HVGO to pentane soluble pitch equal to 88:12 has a composition that meets all of the RME180/IF180 specifications.

The blend with the ratio of HVGO to pentane soluble pitch equal to 88:12 was measured to have less than 2 wppm sodium. It was expected that all of the blends had a sodium concentration of less than 2 wppm.

Example 3

An SHC reactor was used to convert vacuum residue of bitumen from Peace River, Alberta, Canada at a pitch conversion level of 87 wt-%. The SHC product was separated to provide a pitch product. The pitch product had the properties given in Table III.

TABLE III

| | |
|---|---|
| Pitch Density, g/cc | 1.185 |
| Nickel, wppm | 120 |
| Vanadium, wppm | 109 |

The pitch product was then subjected to solvent separation using a several solvents to extract DAO. The concentration of metals and density of the pitch lifted by different solvents was examined and shown in Table IV.

TABLE IV

| Solvent | Solvent Density, g/cc | Extracted oil wt-% | Nickel, wppm | Vanadium, wppm | Nickel + Vanadium, wppm | Extracted oil density, g/cc |
|---|---|---|---|---|---|---|
| pentane | 0.6312 | 15.7 | 7.0 | 3.0 | 10.0 | 1.074 |
| hexane | 0.6640 | 25.1 | 20.7 | 14.5 | 35.2 | 1.079 |
| heptane | 0.6882 | 32.4 | 31.6 | 22.5 | 54.1 | 1.082 |
| toluene | 0.8719 | 81.5 | 99.0 | 93.0 | 192.0 | 1.057 |

In this experiment, the nickel and vanadium concentrations in the extracted oil were found to be linear with either solvent density or wt-% yield. Hexane was not actually tested but properties were therefore interpolated between pentane and heptane based on solvent densities. It was surprising that such little nickel and vanadium was present in the oil extracted from pitch.

Without further elaboration, it is believed that one skilled in the art can, using the preceding description, utilize the present invention to its fullest extent. The preceding preferred specific embodiments are, therefore, to be construed as merely illustrative, and not limitative of the remainder of the disclosure in any way whatsoever.

In the foregoing, all temperatures are set forth in degrees Celsius and, all parts and percentages are by weight, unless otherwise indicated.

From the foregoing description, one skilled in the art can easily ascertain the essential characteristics of this invention and, without departing from the spirit and scope thereof, can make various changes and modifications of the invention to adapt it to various usages and conditions.

The invention claimed is:

1. A hydrocarbon composition comprising:
no less than 73 wt-% aromatics;
no more than 5 wt-% heptane insolubles; and
no more than 50 wppm vanadium;
wherein at least 80 vol-% of said composition boils at a temperature above 426° C. (800° F.) and 12 to 21 wt-% of said composition is pentane-soluble pitch extract.

2. The hydrocarbon composition of claim 1 further comprising no more than 5 wt-% hexane insolubles.

3. The hydrocarbon composition of claim 2 comprising less than 30 wppm vanadium.

4. The hydrocarbon composition of claim 1 further comprising no more than 5 wt-% pentane insolubles.

5. The hydrocarbon composition of claim 4 further comprising less than 10 wppm vanadium.

6. The hydrocarbon composition of claim 1 wherein at least 90 vol-% of said composition boils at a temperature above 426° C. (800° F.).

7. The hydrocarbon composition of claim 1 having a viscosity of no more than 180 cSt at 50° C.

8. The hydrocarbon composition of claim 1 further comprising no less than 75 wt-% aromatics.

9. The hydrocarbon composition of claim 1 further comprising no more than 5 wppm of sodium.

10. A hydrocarbon composition comprising:
no less than 73 wt-% aromatics;
no more than 5 wt-% heptane insolubles;
no more than 5 wppm of sodium;
no more than 50 wppm vanadium; and
an average molecular weight of no more than 500;
wherein at least 80 vol-% of said composition boils at a temperature above 426° C. (800° F.) and 12 to 21 wt-% of said composition is pentane-soluble pitch extract.

11. The hydrocarbon composition of claim 10 further comprising no more than 5 wt-% hexane insolubles.

12. The hydrocarbon composition of claim 11 comprising less than 30 wppm vanadium.

13. The hydrocarbon composition of claim 10 further comprising no more than 5 wt-% pentane insolubles.

14. The hydrocarbon composition of claim 13 further comprising less than 10 wppm vanadium.

15. The hydrocarbon composition of claim 11 wherein at least 90 vol-% of said composition boils at a temperature above 426° C. (800° F.).

16. The hydrocarbon composition of claim 10 having a viscosity of no more than 180 cSt at 50° C.

17. The hydrocarbon composition of claim 10 further comprising no less than 75 wt-% aromatics.

18. A hydrocarbon composition comprising:
no less than 73 wt-% aromatics;
no more than 5 wt-% pentane insolubles;
no more than 5 wppm of sodium;
no more than 10 wppm vanadium;
a viscosity of no more than 180 cSt at 50° C.; and
an average molecular weight of no more than 500;
wherein at least 80 vol-% of said composition boils at a temperature above 426° C. (800° F.) and 12 to 21 wt-% of said composition is pentane-soluble pitch extract.

19. The hydrocarbon composition of claim 18 further comprising no less than 75 wt-% aromatics.

20. The hydrocarbon composition of claim 18 wherein at least 90 vol-% of said composition boils at a temperature above 426° C. (800° F.).

* * * * *